US008925219B2

(12) United States Patent
Napurano et al.

(10) Patent No.: US 8,925,219 B2
(45) Date of Patent: Jan. 6, 2015

(54) FOOTWEAR HAVING CLEATS

(71) Applicant: Nfinity IP, LLC, Atlanta, GA (US)

(72) Inventors: Joseph Napurano, Natick, MA (US); Helen Woo, Quincy, MS (US)

(73) Assignee: Nfinity IP, LLC, Atlanta, GA (US)

( * ) Notice: Subject to any disclaimer, the term of this patent is extended or adjusted under 35 U.S.C. 154(b) by 0 days.

(21) Appl. No.: 13/872,537

(22) Filed: Apr. 29, 2013

(65) Prior Publication Data

US 2013/0263478 A1 Oct. 10, 2013

Related U.S. Application Data

(63) Continuation of application No. 29/407,850, filed on Dec. 2, 2011, now Pat. No. Des. 683,113.

(51) Int. Cl.

| | |
|---|---|
| ***A43C 15/00*** | (2006.01) |
| ***A43C 13/04*** | (2006.01) |
| ***A43B 1/00*** | (2006.01) |
| ***A43B 3/00*** | (2006.01) |
| ***A43B 17/02*** | (2006.01) |
| ***A43B 17/03*** | (2006.01) |
| ***A43B 17/08*** | (2006.01) |
| ***A43B 17/10*** | (2006.01) |
| ***A43B 23/26*** | (2006.01) |
| ***A43C 15/16*** | (2006.01) |

(52) U.S. Cl.

CPC ..... *A43C 13/04* (2013.01); *A43B 1/0027* (2013.01); *A43B 3/0031* (2013.01); *A43B 3/0078* (2013.01); *A43B 17/026* (2013.01); *A43B 17/03* (2013.01); *A43B 17/08* (2013.01); *A43B 17/102* (2013.01); *A43B 23/26* (2013.01); *A43C 15/161* (2013.01); *A43C 15/162* (2013.01)

USPC ..... 36/67 R; 36/67 D; 36/134; 36/29

(58) Field of Classification Search

CPC ..... A43B 5/00; A43B 13/26

USPC ..... 36/29, 67 R, 67 D, 134, 54, 136

See application file for complete search history.

(56) References Cited

U.S. PATENT DOCUMENTS

| | | | | | |
|---|---|---|---|---|---|
| 3,156,987 | A | * | 11/1964 | Dassler | 36/114 |
| 3,442,033 | A | * | 5/1969 | Hilburn, Jr. | 36/114 |
| 3,526,976 | A | * | 9/1970 | Jacobs | 36/100 |
| 4,590,693 | A | * | 5/1986 | Kawashima et al. | 36/126 |
| 4,633,600 | A | * | 1/1987 | Dassler et al. | 36/134 |
| 4,955,150 | A | * | 9/1990 | Fagan | 36/136 |
| 5,243,775 | A | * | 9/1993 | Swain | 36/134 |
| 5,359,790 | A | * | 11/1994 | Iverson et al. | 36/136 |
| 5,367,795 | A | * | 11/1994 | Iverson et al. | 36/136 |
| 5,625,964 | A | * | 5/1997 | Lyden et al. | 36/29 |
| 5,628,129 | A | * | 5/1997 | Kilgore et al. | 36/134 |

(Continued)

*Primary Examiner* — Marie Bays

(74) *Attorney, Agent, or Firm* — McClure, Qualey & Rodack, LLP

(57) ABSTRACT

Footwear having an upper and a ground engaging sole, a sock liner disposed above the sole and inside the upper, the sock liner having a hollow channel with a flowable fluid contained therein, the channel having a venturi for restricting the flow of fluid therethrough, and a plurality of cleats secured to the sole, the cleats being rotatably mounted for adjusting their position on the sole, and a tongue with an extension having a pocket for receiving inserts with a design or color complimentary to the uniform of the wearer.

13 Claims, 5 Drawing Sheets

(56) References Cited

U.S. PATENT DOCUMENTS

| | | | | |
|---|---|---|---|---|
| 5,842,291 | A * | 12/1998 | Schmidt et al. | 36/29 |
| 5,894,687 | A * | 4/1999 | Lin | 36/141 |
| 5,979,083 | A * | 11/1999 | Robinson et al. | 36/127 |
| 6,178,663 | B1 * | 1/2001 | Schoesler | 36/43 |
| 6,745,499 | B2 * | 6/2004 | Christensen et al. | 36/29 |
| 7,404,242 | B1 * | 7/2008 | Perler | 24/712.2 |
| 7,428,790 | B2 * | 9/2008 | Pellerin | 36/134 |
| 7,866,064 | B2 * | 1/2011 | Gerber | 36/62 |
| 8,601,724 | B2 * | 12/2013 | Shiue et al. | 36/127 |
| 2002/0046476 | A1 * | 4/2002 | Snyder | 36/136 |
| 2002/0100190 | A1 * | 8/2002 | Pellerin | 36/126 |
| 2002/0178619 | A1 * | 12/2002 | Schaudt et al. | 36/128 |
| 2003/0217484 | A1 * | 11/2003 | Christensen et al. | 36/29 |
| 2003/0230007 | A1 * | 12/2003 | Walton | 36/15 |
| 2005/0000119 | A1 * | 1/2005 | McMullin | 36/134 |
| 2006/0162189 | A1 * | 7/2006 | Shuttleworth et al. | 36/67 R |
| 2009/0077833 | A1 * | 3/2009 | Kokavec | 36/134 |
| 2010/0212190 | A1 * | 8/2010 | Schmid | 36/127 |
| 2012/0005924 | A1 * | 1/2012 | Shiue et al. | 36/127 |
| 2013/0047465 | A1 * | 2/2013 | Auger et al. | 36/66 |

* cited by examiner

FOOTWEAR HAVING CLEATS

This application is a Continuation of U.S. Design application Ser. No. 29/407,850, filed Dec. 2, 2011, the contents of which are incorporated herein by reference.

BACKGROUND

In certain sporting activities that are played on either grassy surfaces, surfaces with artificial turf, or on bare ground, participants typically wear footwear having cleats projecting from the bottom of the footwear in order to provide stability and traction. Such sports include, but are not limited to, baseball, softball, football, soccer, golf, rugby, and track and field, among others. In some cases, footwear has been customized and developed for a particular sport, for example, footwear having short sharp spikes or cleats are used for many track and field events due to the events being held primarily on bare ground or on tracks composed of hard-packed but soft surfaces, such as clay or cinders and the like. Sports that are played on similar surface types, for example, football and soccer, may have footwear that is customized to an extent for the particular sport; however, footwear for such sports played on similar surfaces can be interchangeable. Footwear developed for baseball and softball must provide the athlete with stability and traction on more than one surface, as these sports combine grassy or artificial turf playing surfaces with infields or base paths composed of dirt or clay. As such, the typical baseball or softball cleat is a relatively short, relatively wide cleat resembling the blade of a spade that is used as a tool for digging in dirt or grass. Typically, such cleats are formed from metal or a hard plastic and project radially approximately ½ inch from the sole of the shoe.

Similar versions of such cleats have, by comparison, relatively short cleats that are used by athletes playing on artificial turf surfaces. The artificial turf typically provides a uniform texture, making longer cleats unnecessary for traction. In addition, longer cleats may be prone to catch on an artificial surface, possibly resulting in injury to the athlete. Whether the cleats are short or longer, present baseball or softball-type cleats may be provided as a one to three-sided cleat; the cleats normally being spaced from each other around the perimeter of the sole of the shoe. The cleats may or may not be interchangeable as wear and tear occurs and, if interchangeable, will be provided with a screw-type or other fastener in which the cleat itself has a portion formed with threads to engage corresponding holes in the sole of the shoe or a screw may be inserted through the cleat and into the sole of the shoe to fasten the cleat to the sole. Very little innovation has taken place in baseball or softball type cleats over the years. Innovation has primarily taken the form of the utilization of softer materials for use by children participating in the sports or the shortening of cleats for use on artificial turf surfaces.

SUMMARY

It is, therefore, an object of the present disclosure to provide a different cleat system for baseball or softball type footwear, although utility may also be found in other sports. Another object is to provide the athlete with an extremely versatile system that can be customized by and for the wearer. Another object is to provide increased comfort for the wearer.

Disclosed is footwear in the form of a shoe having cleats with at least one downwardly projecting lug or spike. The cleats are provided with a screw type or a click lock type fastener for attaching the cleats to the sole of the shoe. The cleats are removable and rotatable to a plurality of locations around their mount to accommodate athletes playing certain positions, having certain tendencies in running, and having different foot types.

Also included in the present disclosure is a comfort system for the shoes in which an internal fluid system is used below the sock liner to distribute the athlete's weight while running or while engaged in playing the game. The fluid is responsive to pressure generated on the sock liner during use.

A further aspect of the present disclosure deals with a decorative component deployed in the protective flap which extends radially from the tongue of the shoe and is folded forwardly over the laces to help protect the athlete's instep.

Additional advantages and features of the present disclosure will become apparent from the following detailed description, with reference being made to the accompanying drawings.

DETAILED DESCRIPTION

Figure 1:
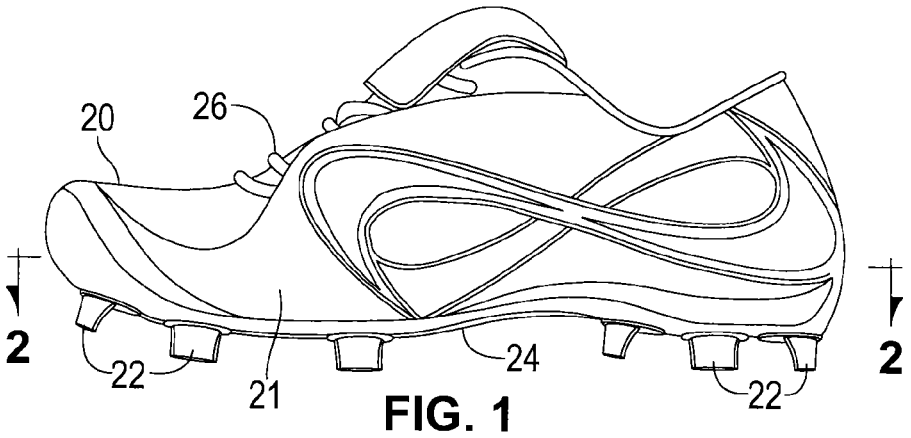
FIG. 1 is a side elevational view of the present shoe.
Figure 8A:
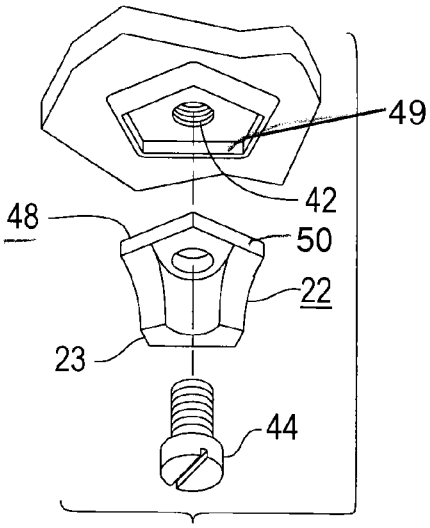
FIG. 8A is a partial exploded view showing the attachment means for a cleat.
Figure 8B:
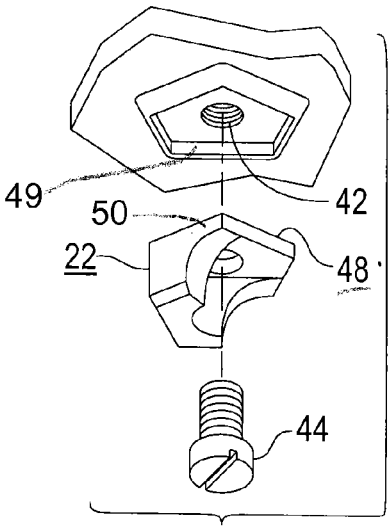
FIG. 8B is a partial exploded view showing the cleat rotated to a different position than that shown in FIG. 8A.
Figure 9:
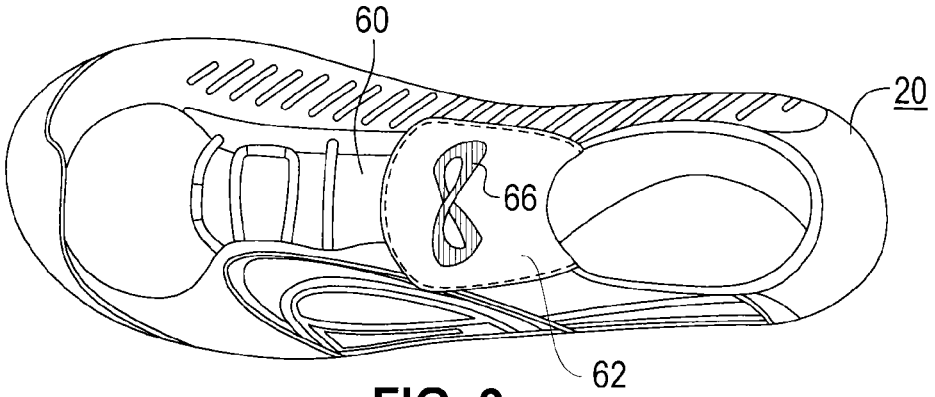
FIG. 9 is a top plan view showing the decorative element located in the protective tongue extension.
Figure 10:
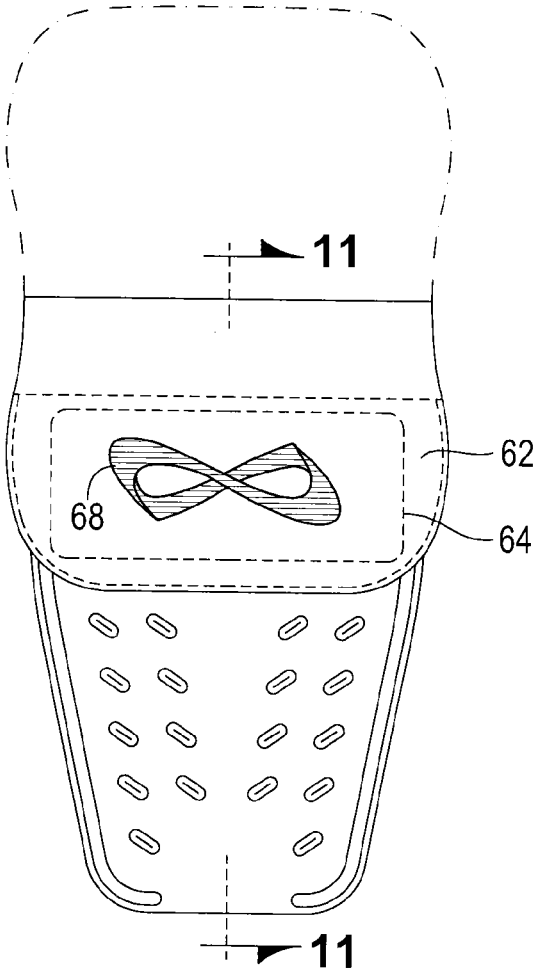
FIG. 10 is a partial diagrammatical view of the decorative element in the tongue extension.
Figure 11:
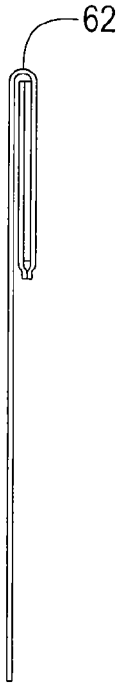
FIG. 11 is a partial cross-sectional view taken along line 11-11 of FIG. 10 illustrating the pocket formed in the tongue extension.
Figure 12:
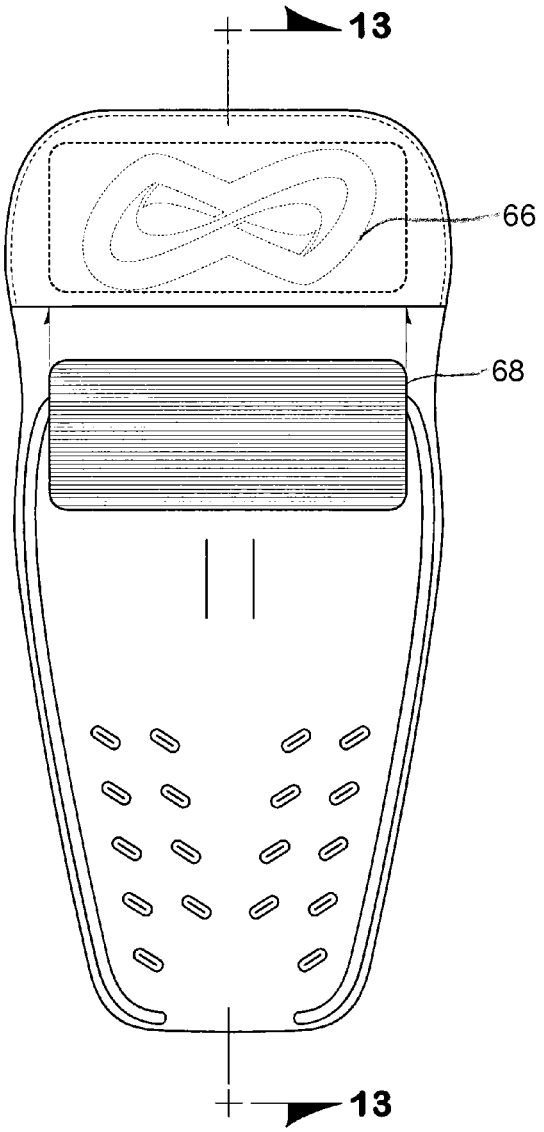
FIG. 12 is a partial diagrammatical view showing the process of inserting a different decorative element into the tongue extension.
Figure 13:
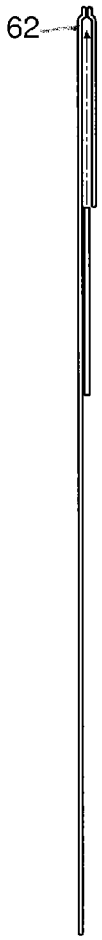
FIG. 13 is a partial cross-sectional view taken along lines 13-13 of FIG. 12 illustrating the process of insertion of the decorative element.

Referring now more specifically to the drawings and to FIG. 1 in particular, numeral 20 designates generally the present footwear, here shown as a softball or baseball shoe. The shoe has an upper 21 bonded to the sole 24. The shoe has cleats 22 projecting from the bottom or sole 24 of the shoe. For purposes of this application, the term cleat includes a base 48, a fastener 44, and a ground-engaging lug or spike 23, as seen in FIG. 8A. The sole is comprised of a wear resistant material, e.g. rubber, plastic, etc., for engaging the ground while the upper may be leather, vinyl, plastic, fabric, or a combination of materials. The cleats are typically distributed around the perimeter of the sole so as to provide traction for the athlete at substantially all of the points where the shoes engage the ground. The cleats may also be positioned on one side of the sole and not the other; positioned with more cleats on one side versus the other; positioned centrally; or in any number of asymmetrical orientations, depending on the wearer, the sport, the position the wearer is playing in the particular sport, etc. The cleats can be customized in a plurality of configurations, and can also be configured to aid rehabilitation for an athlete working back into a sport or recreational activity after an injury. The cleats can be as shown in FIG. 1 or can have a shortened or reduced profile for sports played on artificial turf. The shoe has laces 26 to secure the shoe to the foot of the athlete; however, other means of fastening, such as a hook and loop fastener or other means can be employed.

Figure 2:
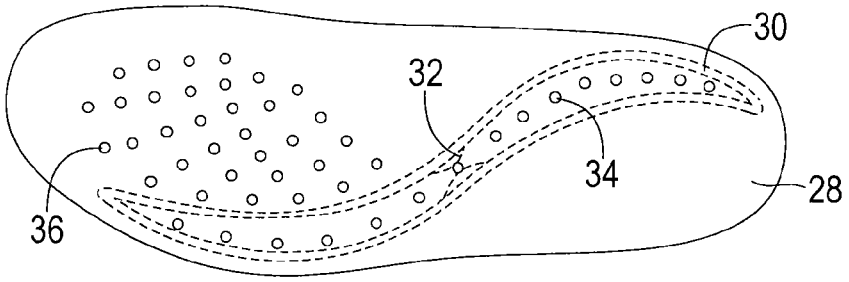
FIG. 2 is a partial cross-sectional view taken along line 2-2 of FIG. 1 illustrating the fluid based comfort system.
Figure 3:
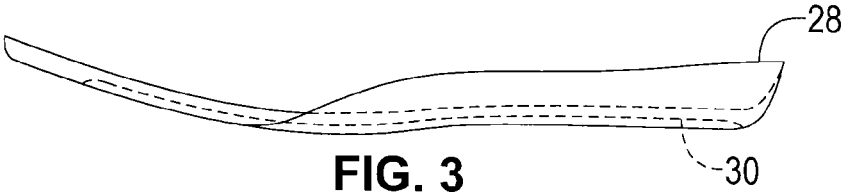
FIG. 3 is a partial side elevational view of the fluid system shown in FIG. 2.
Figure 4:
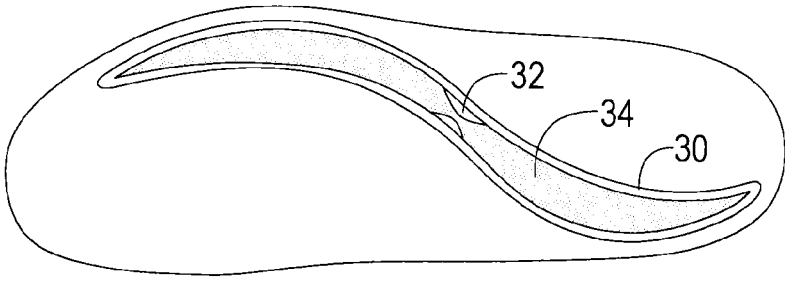
FIG. 4 is a partial bottom plan view of the fluid based comfort system.

FIGS. 2-4 illustrate respectively the top, side, and bottom views of the sock liner 28. Disposed within the sock liner is a hollow channel 30 that extends from the inside of the heel to the outside of the foot in a transverse pattern from front to back. The location of the channel is designed to provide additional support and comfort where the high pressure is applied by the athlete during the use of the shoe. The channel has a generally centrally located venturi 32 and is filled with a fluid 34 which may be gel, air, or a similar flowable substance. Whatever fluid is used, the sock liner is normally compression molded ethylene vinyl acetate (EVA) with a welded edge to contain the fluid. Other materials can be utilized using the same design. The venturi restricts the flow of the fluid from front to back and vice versa as pressure is applied to the channel by the foot of the athlete during use. The venturi thus serves to restrict the distribution of the fluid as pressure is applied, thus helping to maintain pressure for support while still providing comfort from the movable fluid. The sock liner is also provided with vent holes 36 to promote air circulation and wicking away of moisture from the foot. The holes also provide a visual indicator of the fluid system.

Figure 5:
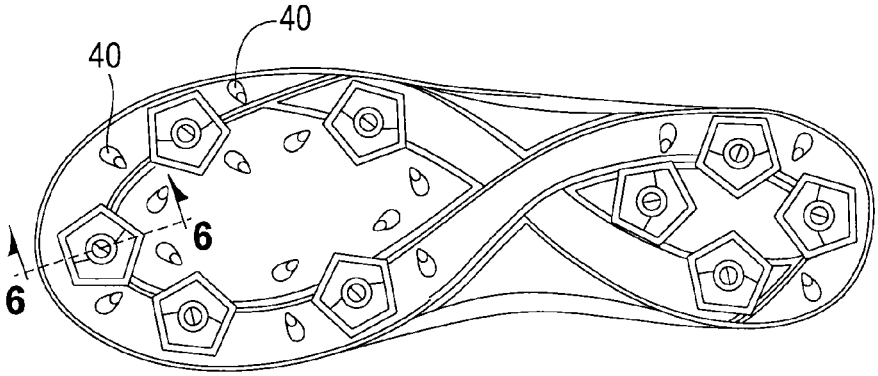
FIG. 5 is a bottom plan view of the present shoe.
Figure 6:
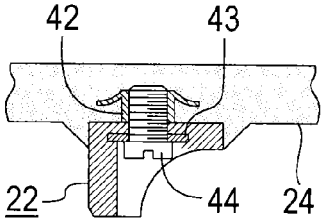
FIG. 6 is a partial cross-sectional view of one of the cleats mounted on the sole of the shoe.
Figure 7:
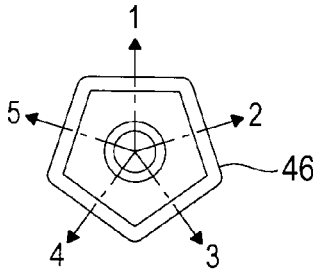
FIG. 7 is a diagrammatical plan view showing different positions at which the cleat can be mounted.

FIGS. 5-8B illustrate one embodiment of the cleat system of the present shoe. As noted, the cleats can be as shown or can have a shortened or reduced profile and different geometries. As can be seen in FIG. 5, the shoe has five cleats distributed more or less evenly around the forward perimeter of the shoe and four cleats distributed in a generally circular pattern around the heel of the shoe. As noted, the number of cleats can be varied depending on the sport, whether the shoe is for a male or female, or simply by design. The sole 24 of the shoe may also include studs 40 distributed around the bottom of the sole for added traction and stability for the athlete. In the cross-section shown in FIG. 6, the sole 24 is provided with sockets 42 having an internal metal support 43. The sockets receive the cleat 22 and a screw 44 or similar fastener for attaching the cleat to the sole of the shoe.

Surrounding the socket is a molded receptacle 46 which receives the corresponding base 48 of the cleat. The receptacles have a plurality of internal side walls 49, and are shown here with five side walls. The base of the cleat has a corresponding number of facets 50 so as to position and help secure the cleat in the desired position. The receptacle 46 projects outwardly from the sole 24. This provides the wearer with a visual indicator of which rotated position the cleat is in. The number of side walls of the receptacles and the facets of the base can vary, but the number of the side walls will correspond to the number of facets. It is also contemplated that the molded receptacle could be circular or oval, so that the position of the cleat can be rotated to any of a number of different positions; enabling the wearer to customize the footwear to their individual needs. Once the base of the cleat is positioned where the wearer chooses, it is locked into place against rotation by engagement of the side walls with the facets of the base.

Thus, in the embodiment shown in FIGS. 5-8, the cleat can thus be positioned in any of five different locations within the receptacle 46 in the embodiment shown here so that the athlete can customize the location of the cleats based on factors such as position played, comfort, and traction requirements. For example, the catcher on a baseball or softball team is typically in a squatted position. The catcher can arrange the cleats to provide traction on the inside, outside, or middle of that portion of the sole where each individual cleat is located, depending on the particular stance that the catcher adopts. Similarly, as a pitcher typically pushes off of the mound with one foot while delivering the ball, the cleats can be arranged to provide the maximum stability for the foot engaging the mound during delivery of the pitch. The pitcher can locate the cleats on the opposite foot in a different position to provide stability and traction while adjusting from the role of pitcher to the role of fielder after the pitch is delivered. FIGS. 8A and 8B demonstrate how the cleat can be rotated to a different position at approximately 72° intervals of rotation for a pentagonal mount.

FIGS. 9-13 illustrate an additional aspect of the present footwear system. The tongue 60 of the shoe is typically provided with an extension 62 which extends out from the shoe and is folded over toward the front of the shoe to overlay the laces and the instep of the athlete. This provides an element of decoration and protection for the athlete at a particularly vulnerable part of the foot as the instep is the part of the shoe that is most likely to be stepped on by a competitor during a game or practice. The extension 62 is provided with a pocket 64 having a clear window 66 which may have a logo or other design. An insert 68 of paper, plastic, leather or other suitable material and having a color or design complimentary to the team uniforms, is inserted in the pocket as shown in FIGS. 10-13, for customizing the look of the shoe. This means of customization of the shoe can be used for identification or changed to accommodate different colors in, for example, home and away uniforms employed by the team.

Figure 14:
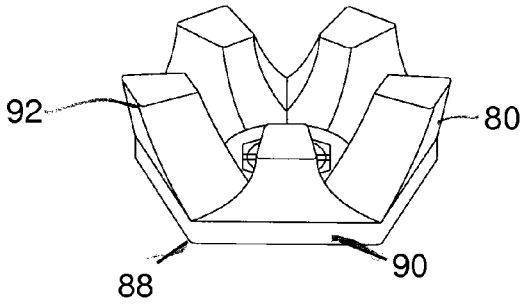
FIG. 14 is a side elevational view of a representative cleat.
Figure 15:
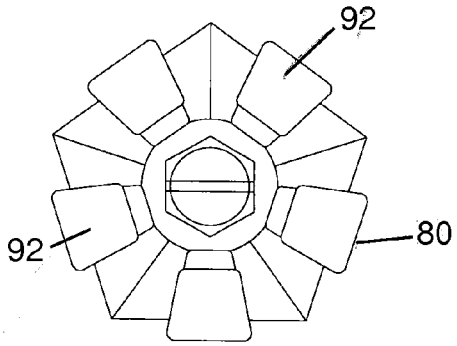
FIG. 15 is a top plan view of the cleat shown in FIG. 14.
Figure 16:
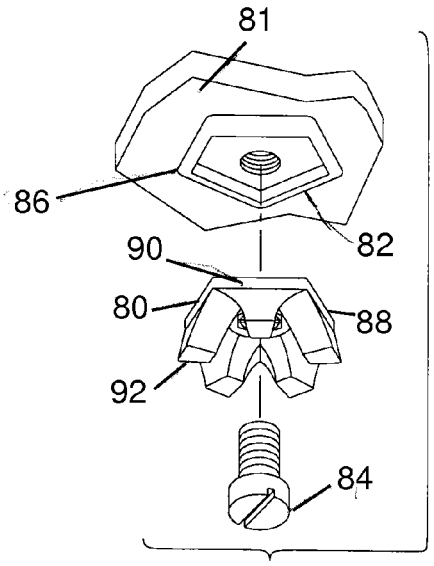
FIG. 16 is a partial, exploded, perspective view of the sole of a shoe, a cleat, and a fastener.

Another embodiment of a cleat design is shown in FIGS. 14-16. The cleat 80 is designed to be attached to the sole 81 of the footwear through a threaded socket 82 using fastener 84. The socket may have an internal support means as well, similar to the metal support 43 discussed hereinabove. Surrounding the socket is a molded receptacle 86 which receives the corresponding base 88 of the cleat. The receptacle has a plurality of internal side walls 89, which receive cleats with a corresponding number of facets 90. This arrangement locks the cleat in the position desired by the user.

Cleat 80 has spikes 92 for engaging the ground, playing surface, or walking surface. The spikes 92 are of a lower profile than spikes used for baseball or softball, and are suitable for golf, soccer, or other sports or activities, such as power walking, that either require less grip, or require that the spikes do not catch on the surface, as in soccer, or that do not penetrate, for example, a golf green.

Where, as in certain activities such as golf, a wearer may wear down the spikes 92, faster on a certain side of the cleat, the adjustability feature is highly advantageous. With the embodiment shown in FIGS. 14-16, the cleats can be rotated if wear occurs on one side or the other, thus prolonging the useful life of the cleat. While the cleats 80 are shown as having substantially the same length and width for the spikes, the length and width can vary, when required or desired by the user.

Thus, while an embodiment and modifications thereof of footwear in the form of a sports shoe with cleats has been shown and described in detail herein, various additional changes and modifications may be made without departing from the scope of the present disclosure.

At least the following is claimed:

1. A sport shoe comprising an upper and a ground engaging sole, the sole having a plurality of cleats for providing stability and traction, the cleats being rotatable for adjusting their position on the sole, said sole further including receptacles for receiving said cleats, the receptacles having at least five side walls and projecting outwardly from said sole for providing a visual indication of the position of the cleat.

2. A sport shoe as defined in claim 1 in which the sole further includes sockets and fastening elements for securing the cleats thereto.

3. A sport shoe as defined in claim 2 in which the cleats include a base having a shape that corresponds to the receptacle.

4. A sport shoe as defined in claim 1 in which the shoe includes a sock liner above the sole and inside the upper for receiving the foot of the wearer, the sock liner having a channel formed therein with a fluid contained in the channel.

5. A sport shoe as defined in claim 4 in which the channel has a generally centrally located venturi for restricting the flow of the fluid therethrough.

6. Footwear comprising an upper and a ground engaging sole, a sock liner disposed above the sole and inside the upper, the sock liner having a hollow channel with a flowable fluid contained therein, the channel having a venturi for restricting the flow of fluid therethrough, and a plurality of cleats secured to the sole, the cleats being rotatably mounted for adjusting their position on the sole, and said sole including receptacles with at least five sides for receiving said cleats, said receptacles projecting outwardly from said sole.

7. Footwear as defined in claim 6 in which the sole further includes sockets and fastening elements for securing the cleats thereto.

8. Footwear as defined in claim 7 in which the cleats include a base having a shape that corresponds to the receptacle.

9. Footwear as defined in claim 6 and including a tongue connected to the upper and disposed to cover the instep of the wearer, said tongue having an extension with a clear window facing upwardly and a pocket disposed below said clear window, and including an insert receivable into said pocket.

10. Footwear as defined in claim 9 in which said insert has a design thereon.

11. Footwear as defined in claim 10 in which said insert has a color.

12. Footwear comprising an upper and a ground engaging sole secured thereto, the sole having receptacles formed therein, said receptacles having at least five sides and projecting outwardly from said sole, and a plurality of cleats corresponding to said receptacles and secured therein in one to one relationship, said cleats being rotatable for adjusting their position on the sole, whereby said cleats are rotatable in increments of seventy-two degrees or less for customizing the cleat arrangement to the requirements of the wearer.

13. Footwear as defined in claim 12 in which the cleats have a plurality of facets for positioning the cleat in a desired position.

* * * * *